US005785118A

United States Patent [19]

Nagel et al.

[11] Patent Number: 5,785,118

[45] Date of Patent: Jul. 28, 1998

[54] HEATING DEVICE FOR A MACHINE PRODUCING CORRUGATED CARDBOARD

[75] Inventors: Klaus Nagel, Halstenbek; Swen Joerissen, Kiel, both of Germany

[73] Assignee: Peters Maschinenfabrik GmbH, Hamburg, Germany

[21] Appl. No.: 749,631

[22] Filed: Nov. 15, 1996

[30] Foreign Application Priority Data

Nov. 15, 1995 [CH] Switzerland ..... 03231/95

[51] Int. Cl.[6] ..... F28F 3/14

[52] U.S. Cl. ..... 165/170; 165/82

[58] Field of Search ..... 165/170, 82, 168

[56] References Cited

U.S. PATENT DOCUMENTS

| | | | |
|---|---|---|---|
| 2,085,191 | 6/1937 | Hastings | 165/170 |
| 3,237,687 | 3/1966 | Combes | 165/168 X |
| 4,484,623 | 11/1984 | Rowe et al. | 165/170 X |
| 4,678,027 | 7/1987 | Shirey et al. | 165/170 X |
| 4,739,825 | 4/1988 | Van Dusen et al. | 165/170 X |
| 5,183,525 | 2/1993 | Thomas | 165/168 X |
| 5,501,762 | 3/1996 | Marschke et al. | 165/168 X |

FOREIGN PATENT DOCUMENTS

| | | | |
|---|---|---|---|
| 0 460 872 | 12/1991 | European Pat. Off. . | |
| 10 88 794 | 9/1960 | Germany . | |
| 22 13 745 | 10/1974 | Germany . | |
| 26 04 879 | 8/1977 | Germany . | |
| 3422684 | 12/1985 | Germany | 165/170 |
| 886589 | 1/1962 | United Kingdom . | |
| 1 554 992 | 10/1979 | United Kingdom . | |

*Primary Examiner*—Leonard R. Leo
*Attorney, Agent, or Firm*—Hill & Simpson

[57] ABSTRACT

A heating device for corrugated cardboard comprises a heating member which is formed by a heating plate consisting of a rectangular plate having side walls, front and back walls integral with the plate and a lower or bottom surface of the plate is connected to a sheet of deformed steel having a small thickness to present cells or passages which are obtained by deformation. The front and back borders of the sheet of steel have been folded at 45° angles so as to form a front chamber and a back chamber that act as manifolds for the flow of fluid in the passages. The heating member is connected in a floating manner to a rigid sub-frame by means of rods, and the whole sub-frame and member are also connected in a floating manner to the main frame of the machine that produces the corrugated cardboard.

9 Claims, 9 Drawing Sheets

HEATING DEVICE FOR A MACHINE PRODUCING CORRUGATED CARDBOARD

BACKGROUND OF THE INVENTION

The present invention is directed to a heating device for a machine that produces corrugated cardboard, in particular to a heating device utilizing convection from a heating fluid circulating in a heated plate or heat exchanger.

Heating devices which are presently used today in the field of manufacturing corrugated cardboard consist generally of a heat exchanger having an iron frame in which saturated steam is circulated in spiral channels. The iron frame presents a flat surface for heat transfer with the cardboard which is to be heated, which surface is smooth and plain. This kind of device presents a certain advantage by the fact that the heat transfer surface, which is smooth and planar, does not keep the dust and impurities carried by the passage of the cardboard. Thus, the maintenance is simplified and the heat transfer between the cardboard and a transfer surface is very acceptable. Nonetheless, by reason of the passage of the cardboard of the same thickness as the iron frame, the temperature of the upper surface of the frame is lower than the temperature at the lower part, and this will induce a distortion of the flat surface of the frame, which will thus lose its inherent flatness and greatly disturb the advantages of the device. On the other hand, in view of the great rigidity of the iron frame, the forces necessary to correct the deformation of the upper surface of the frame are so great that it is difficult or even impossible to correct for the distortion of the flatness of the surface by any mechanical means. In addition, such a construction presents a disadvantage requiring a heavy construction which will induce heavy heat losses. This kind of device depends also on a high thermal inertia, which is incompatible with a good temperature control for the heat transfer surface. Since these devices require a large volume of steam to circulate in their channels, these devices require the use of a pressure tank or boiler, which will require a certification.

Another heating device for corrugated cardboard is known, and its construction has the purpose to improve on the structure of the first-described device. In this second heating device, the iron construction has been replaced by a welded construction, which is lighter and comprises a heating plate formed by assembly of a series of steel tubes placed side-by-side. These tubes are interconnected in a manner of a heating coil so as to allow the passage of steam into the heating plate. A covering tube is then welded on the upper surface of the series of tubes so as to present a smooth and planar surface for heat transfer to the cardboard. Such a device is described in greater detail in German Patent 22 13 745. In this construction, the fabrication time is relatively high and the cover tube forms a thermal barrier, which prevents a suitable control of the distribution of the temperature on the transfer surface. In order to improve this situation, it has been suggested to remove the cover tube, but in doing that, another problem occurs which is one of the accumulation of impurities between the different tubes of the heating plate, which impurities induce stains and even damage to the cover sheet of the corrugated cardboard. In order to avoid that, it has been suggested to fabricate the tubes in such a way that the corner edges of the tube in the plane of the transfer surface present a radius of curvature which is as small as possible, however, this fabricating, in particular, is an expensive manufacturing process. On the other hand, it is possible in this device to mechanically correct the deformation of the plane of the transfer surface, however, this correction is still in an imperfect manner due to the inevitable heat transmission between the heating frame and the mechanical means used for the correction of the inherent flatness of the transfer device.

SUMMARY OF THE INVENTION

The object of the present invention is to remove the above-mentioned disadvantages and to supply a heating device for corrugated cardboard which is simple to obtain while presenting certain advantages regarding its weight, its cost for producing and its function.

These objects are obtained in a heating device for a machine producing corrugated cardboard, in particular a heating device utilizing convection from a heating fluid circulated in a plate-like heat exchanger which comprises a heating member in which saturated steam is circulated. The device utilizes a heating member which is formed by a heating table consisting of a rectangular plate member of material formed to have an upper planar surface, a pair of side walls, a front and back wall integrated therewith. A lower or bottom surface of the plate member is connected to a sheet of deformed steel having a small thickness to form a plurality of passages, and the deformed sheet has a front border and a back border folded at 45° to the plane of the bottom surface so as to form a front chamber and a back chamber. The heating member is associated with a rigid sub-frame, in which is it is connected in a manner to take into consideration thermic constraints by a plurality of adjustment elements so as to avoid a heat transmission between the heating member and the sub-frame and that the unit of the sub-frame and heating member is fastened in a floating manner within a frame of the machine for manufacturing corrugated cardboard in a way as to take into consideration the thermal expansion resulting with regard to the heating in the heating member.

Other advantages and features of the invention will be readily apparent from the following description of the preferred embodiments, the drawings and claims.

DESCRIPTION OF THE PREFERRED EMBODIMENTS

Figure 1:
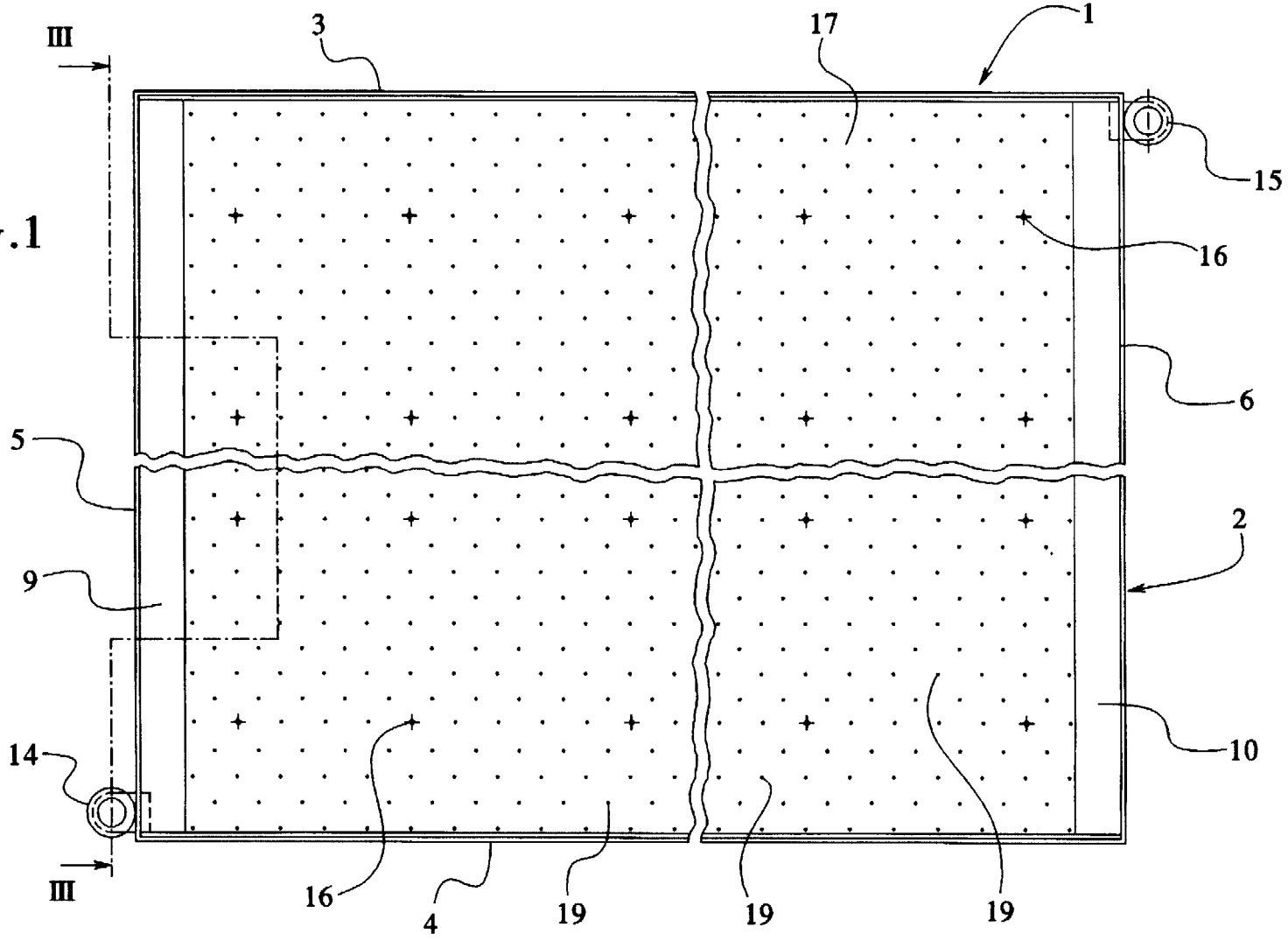
FIG. 1 is a bottom plan view of a heating member in accordance with the present invention.
Figure 2:
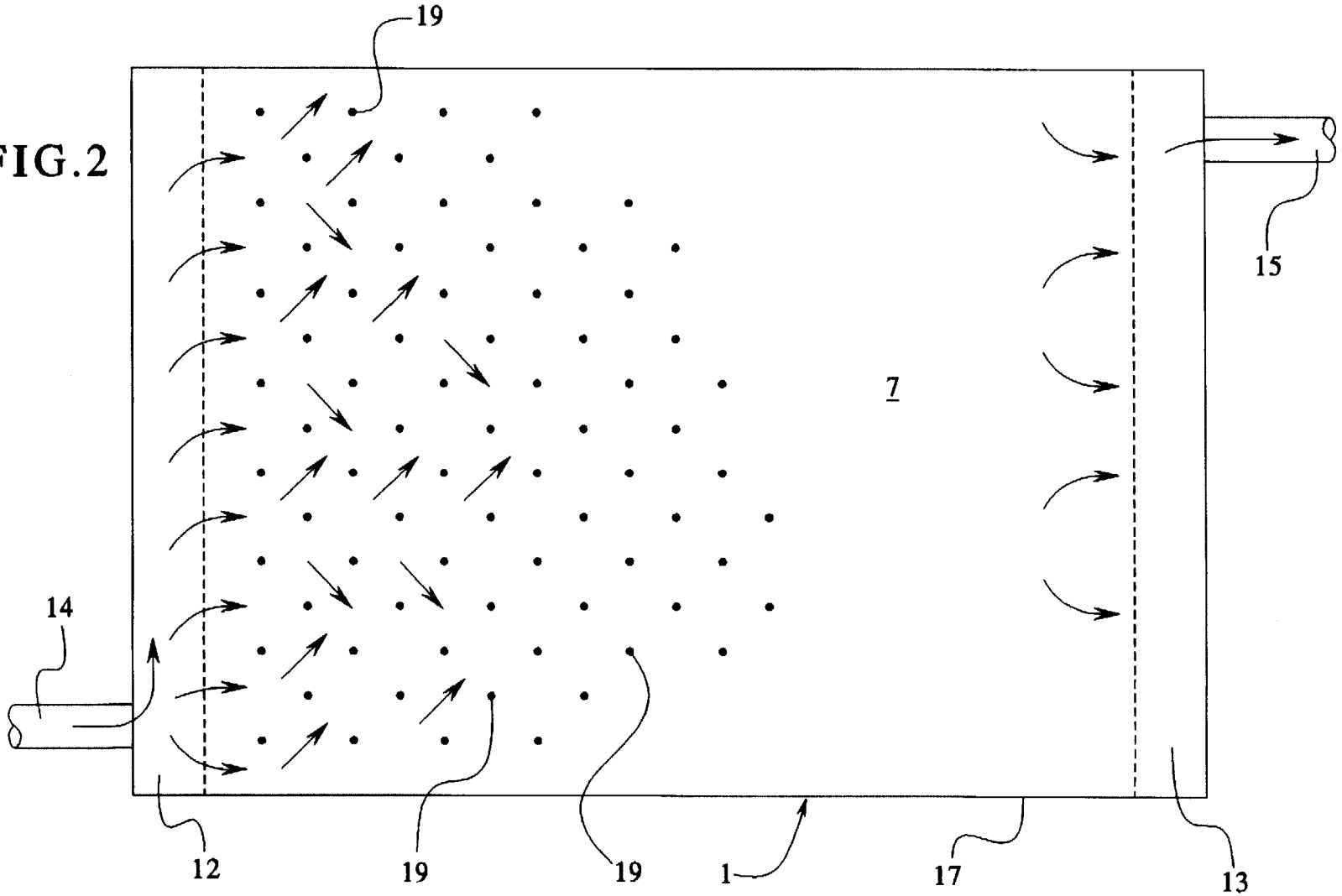
FIG. 2 is a schematic representation of the flow of steam in the heating member of FIG. 1.
Figure 3:
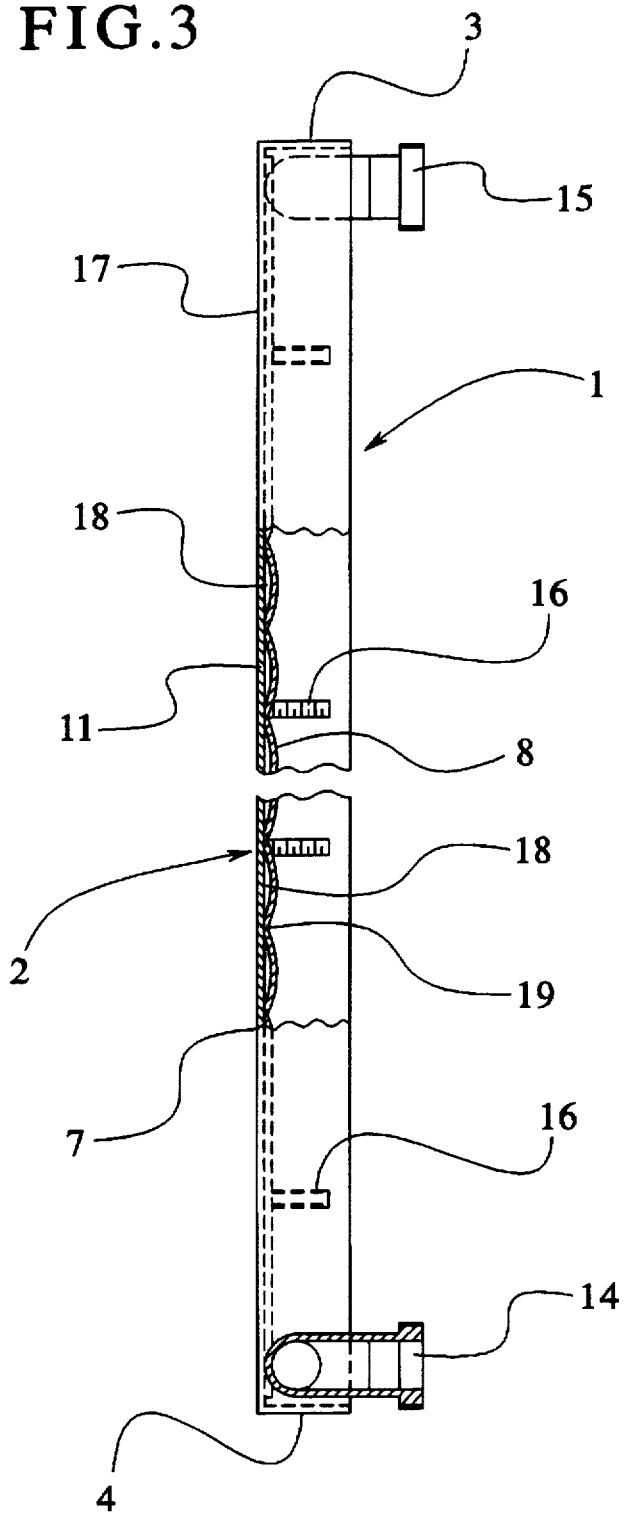
FIG. 3 is a view of the heating member of FIG. 1 taken along the lines III—III of FIG. 1.
Figure 4:
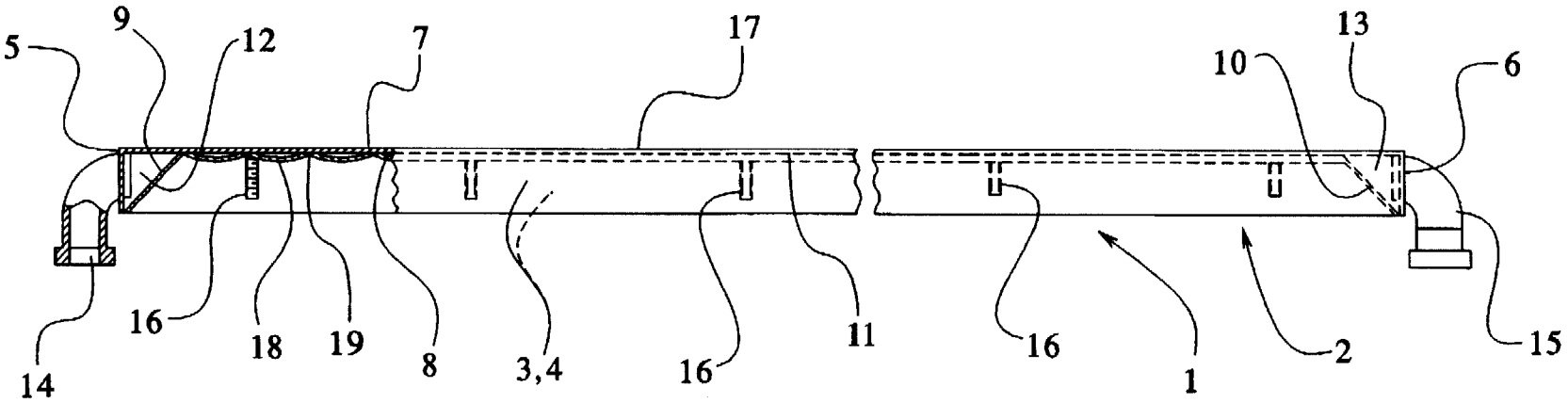
FIG. 4 is a side view with portions broken away for purposes of illustration of the heating member of FIG. 1.
Figure 5:
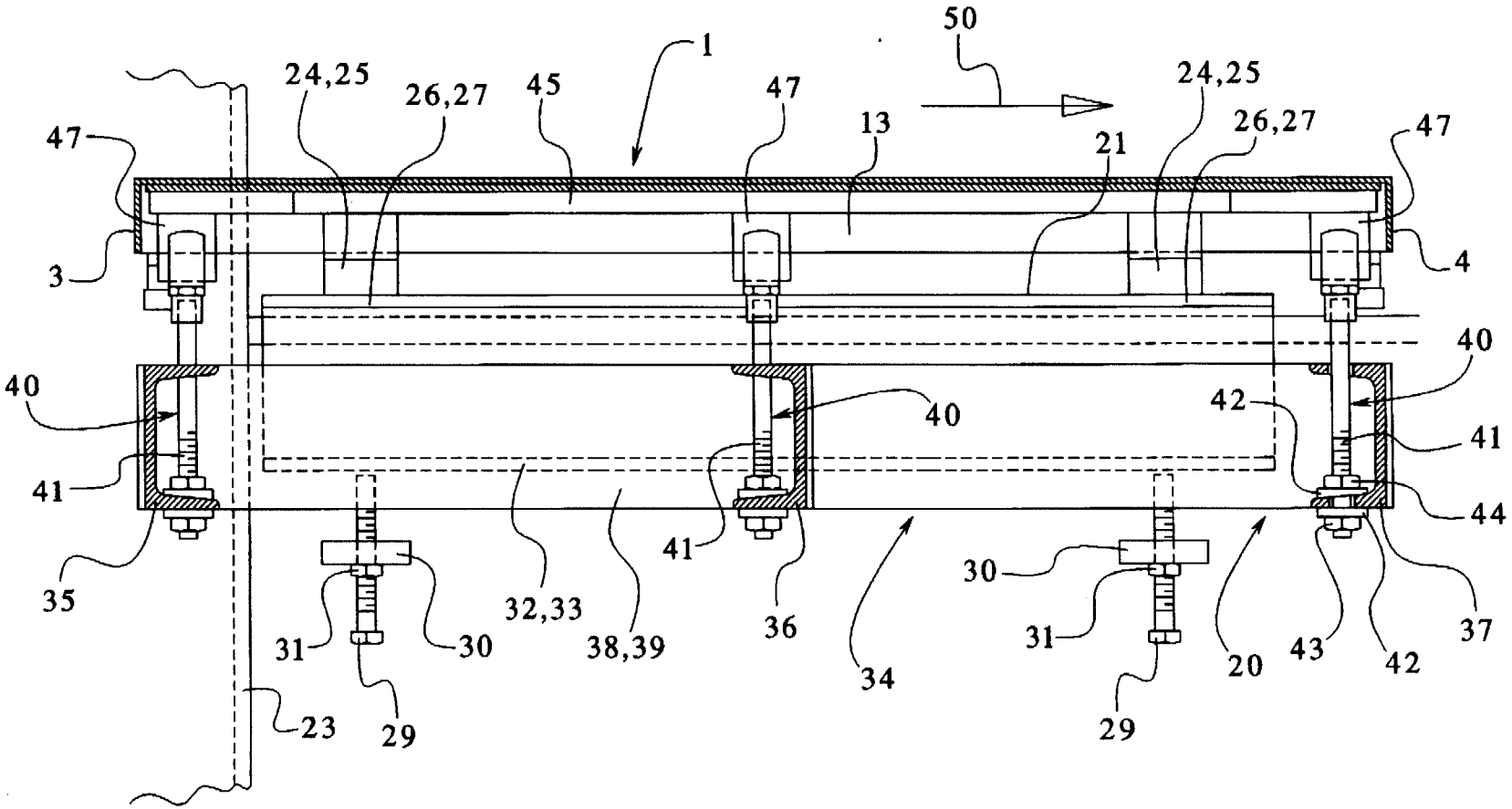
FIG. 5 is a partial longitudinal cross sectional view of the heating device and sub-frame mounted in the frame of a machine for processing corrugated cardboard.
Figure 6:
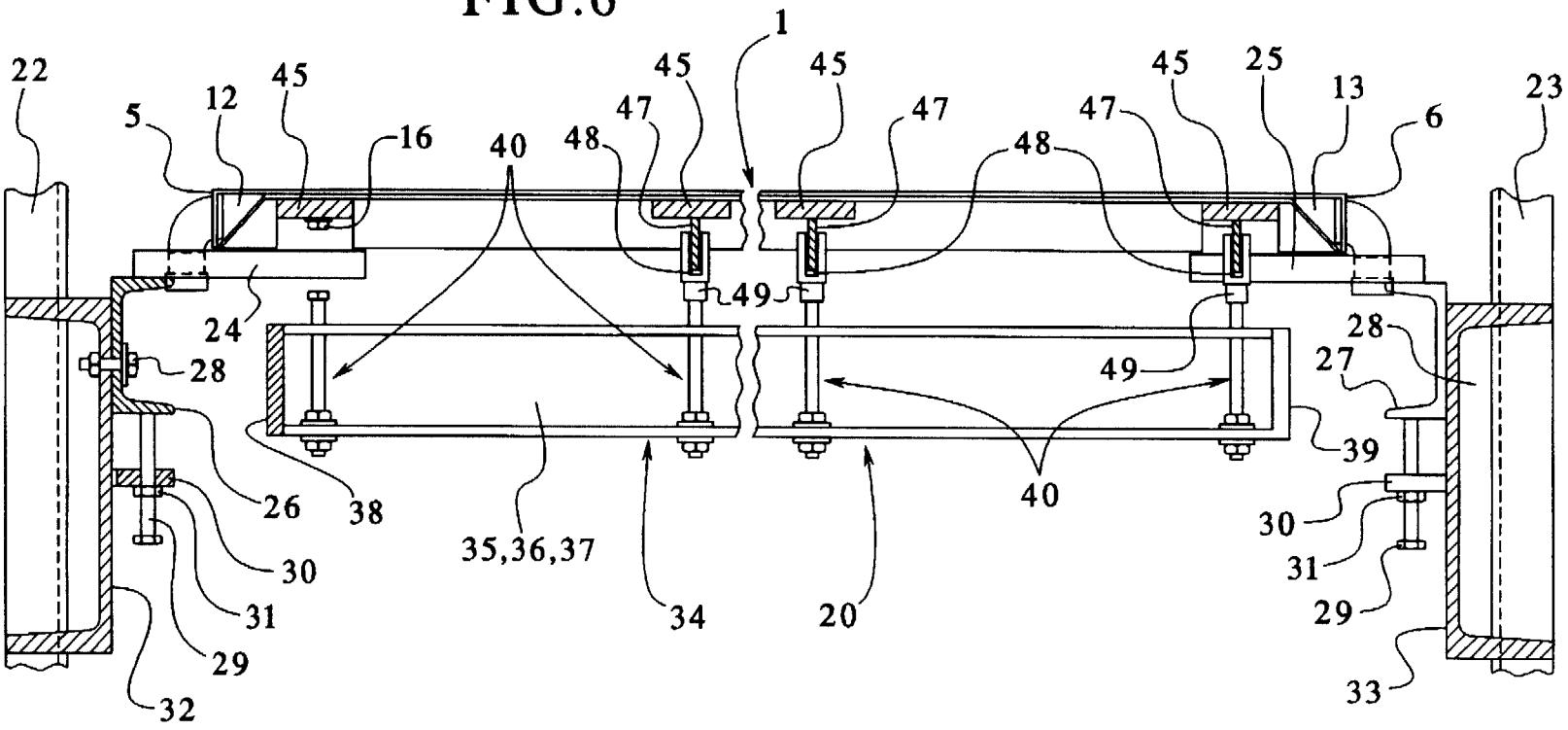
FIG. 6 is a transverse cross sectional view of the device of FIG. 5.

The principles of the present invention are particularly useful when incorporated in a heating member, generally indicated at 1 in FIGS. 1–9. The heating member 1 comprises a heating plate 17 consisting of an open box-like member 2 having a rectangular form with side walls 3 and 4 and end walls 5 and 6, which are integral with a plate member 7, as shown in FIG. 3. The open box 2 can be realized by folding and welding a sheet of steel having a thickness of about 4 mm. Another sheet 8 of steel having a small thickness of about 1.5 mm and whose front border 9 and back border 10 have been folded at 45° away from the plane of the sheet, as illustrated in FIG. 4, is welded on its peripheral edges to the open box member 2, with the front border 9 welded to the edge of the front wall 5 and the back border 10 welded to the edge of the back wall 6 to form a front or side chamber 12 and an opposite side chamber or back chamber 13. This sheet 8 of steel having the small thickness is afterwards connected to the lower part or bottom surface 11 of the plate member 7 by spot welding according to a staggered configuration in such a way that the weld points 19 have a diagonal distance from one another of an adequate distance in a range of between 28 mm to 30 mm. The front chamber 12 is equipped by welding with a connector 14, while the back chamber 13 is equipped by welding with a connector 15. While the chambers 12 and 13 have been described as front and rear chambers, respectively, they could be considered side chambers if the plate 7 were mounted as shown in FIGS. 5 and 6.

After attaching the connectors 14 and 15, the connector, such as 15, is closed up and a fluid under high pressure, for example a hydraulic oil, is induced into the front chamber 12 through the connector 14. The result of the injection of this fluid under pressure into the front chamber 12 causes a warping or deforming of the sheet 8 of steel having the small thickness in such a way as it arches in the areas which are not connected to the bottom surface 7 so as to form interconnecting cells or passages 18. The fluid under pressure is then removed from the heating member 1 and the member will, therefore, be able to receive heating fluid, such as, for example, saturated steam.

The heating member 1 is further provided with a plurality of fixing points, such as 16, which are formed by threaded rods welded at the place of some of the weld points 19, which connect the deformed sheet 8 of steel having the small thickness to the plate member 7. These fixing points 16 are destined to be used as anchor points in order to ensure a perfect connection with a rigid sub-frame, which will be described in greater detail with regard to FIGS. 5 and 6, and so as to allow for the adjustment of the inherent flatness of the heating member as well as to grant a whole acceptable rigidity to the heating member 1.

As schematically illustrated in FIG. 2, the flow of steam into the heating plate 17 of the heating member 1 has the saturated steam injected into the front chamber 12 of the heating plate through the connector 14. The saturated steam is distributed, first, within the front chamber and will cross, in a regular manner, the heating plate 17 by passing through the cells or passages 18 in order to finally flow into the back chamber 13 and to come out of the heating member 1 through the connector or conduit 15. The steam flow is thus divided by the welding points 19 between the sheet 8 of steel having the small thickness and the plate member 7. Because of these connections or points 19, the steam flow will have a turbulent flow which will cause an increase in the heat transfer to the plate member 7, which will be in contact with one surface of the corrugated cardboard. Moreover, owing to the high speed of the steam flow, the steam is pushed at high speeds through the heating plate 17 before being recuperated by a steam collector (not shown), possibly being situated in the lower part of the back chamber 13. The steam may also be exhausted by the connector 15, which is connected to the return circuit for the steam. The choice of the construction presenting passages 18 allows an operation with a low volume of saturated steam which is circulated in the heating plate and which will allow a reduction in the size of the pressure tank or boiler which is indispensable for the existing constructions known today.

The structure of the cells or passages 18, which have been deformed in the sheet 8 of steel having a small thickness, are illustrated in FIGS. 3 and 4 and show how the steel has been bulged, except where it has been attached at the weld points 19 to the plate 7. The thin sheet 8 with the passages 18 has a waffle-shaped pattern or quilted pattern. As illustrated in both FIGS. 3 and 4, the connectors, such as 14, are connected to the chamber 12, while the connector 15 is connected to the chamber 13. While FIG. 3 shows only a single connector for each chamber, a plurality of connectors or connections could be provided for each chamber in order to improve and regulate the flow of the steam.

The heating member 1 is equipped with an adjustment device 20 for adjusting the flatness of the transfer surface or upper surface of the heating member 1, and this is mounted in a frame 21, which is attached to two side frames 22 and 23 of the machine for producing the corrugated board, as illustrated in FIGS. 5 and 6. The heating member 1 has small bars 24 and 25 in order to connect the member 1 in a floating manner on the frame 21. The floating connection is necessary because of thermal expansion of the heating member 1 during operation. The frame 21 is formed by two channel-shaped bars 26 and 27, which are connected to the longitudinal frame members 32 and 33 of the side frames 22 and 23 by bolts or screws 28, as shown in FIG. 6. The adjustment in the height of the frame 21 is realized by means of screws or threaded fasteners 29, which are threaded through brackets 30 welded on the inner surface of the side frame members 32 and 33. The locking in position of the frame 21 is obtained by means of lock-nuts 31 placed on the bolts 29.

The adjustment device 20 of the inherent flatness for the transfer surface of the heating member 1 is formed by a rigid sub-frame 34, which, as illustrated in FIG. 5, is formed by U-shaped channel members 35, 36 and 37, of which only three are represented in FIG. 5. Of course, additional members can be provided according to the number of adjustment points chosen in order to ensure the inherent flatness of the transfer surface of the member 1. These channeled members 35, 36 and 37 are interconnected either by channel members or possibly flat bars, such as 38 and 39 (see FIG. 6).

The heating member 1 is fastened to the rigid sub-frame 34 by rods 40, which may be screwed directly at one end onto the threaded parts of the fixing points 16 (FIG. 3). The other end of the rod 40 presents a threaded part and is fastened by means of a washer 42, a nut 43 and a lock-nut 44 in a lower leg of the channel-shaped members, such as 35, 36 and 37, of the sub-frame 34 (see FIG. 5). In this version, the adjustment of the inherent flatness of the transfer surface occurs by acting on the fixing members of the rods 40 to the sub-frame 34.

Figure 7:
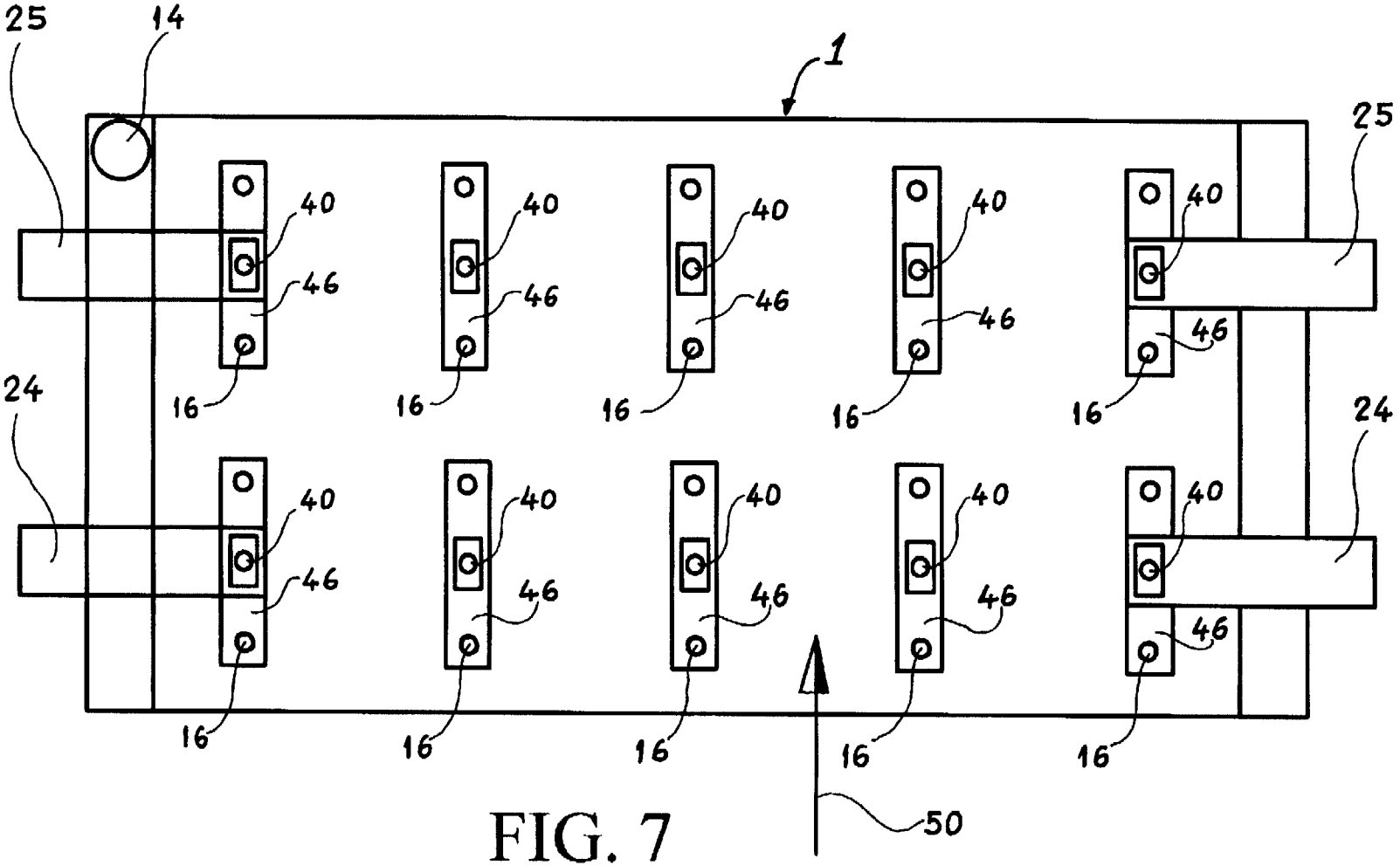
FIG. 7 is a bottom plan view of the heating member with portions added thereto for mounting the heating member in the sub-frame.
Figure 8:
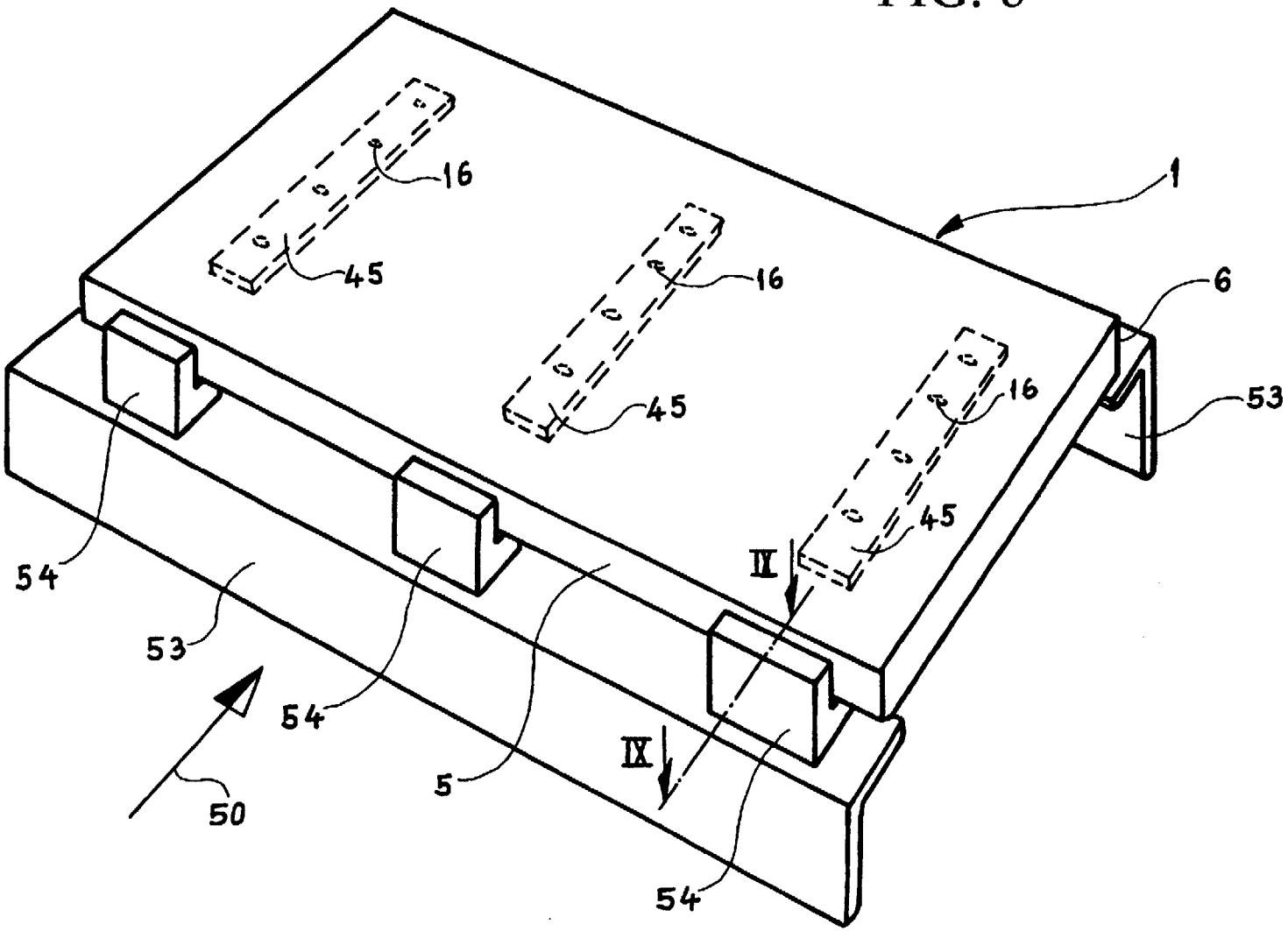
FIG. 8 is a perspective view of an embodiment for mounting the heating device.

In order to obtain an adjustment less point-by-point, it is desirable to place on the fixing points 16, either small bars 45, such as shown in FIG. 8, which extend on the whole width of the transfer surface, or small plates, such as 46, as shown in FIG. 7. The small bars 45 or the small plates 46 are provided with tabs or flaps 47, which will be engaged in slots 48 (see FIG. 6) of a connecting piece 49 threaded on the upper end of each of the rods 40. In order to ensure a fixing of the connecting piece 49 to the tab 47, a screw or a pin is used, which is not shown and which will cross the connecting piece, and will engage into an elongated opening of the tab 47. In order to ensure the lengthwise positioning in the travelling direction of cardboard, which is shown by the arrow 50 in FIG. 5, the tabs 47 on the small bars 45 situated on the upstream side, which is the left-hand side of FIG. 5, are not provided with elongated openings, but with simple round holes or bores. By reason of the utilization of the rods 40, it is also plausible to imagine for these a rigid fixing to the heating member 1. In this case, the thermal deformation of the heating member 1 will be compensated by the deflection of the rods. It is also imaginable that the connection between the upper end of the rods 40 and the tabs 47 is realized by means of a pin crossing the connecting piece 49 in order to engage in a bore which is pierced within the connecting piece 49, and this bore being of a diameter which is larger than the diameter of the pin. The heating member 1 may also be fixed laterally so as to take into consideration the phenomena of the thermal expansion to the frame of the machine by means of small plates, such as 24 and 25, which are illustrated in FIG. 7. This fixing mode allows for the consideration of the constraints of thermal expansion in such a way as these do not have the influence on the inherent flatness of the heat transfer surface. The heating member 1 will, thus, be floating laterally with regard to the frame 21, while being firmly connected to the sub-frame 34 by the rods 40. In this executed form, the adjustment of the inherent flatness will be effected in the same manner as mentioned before by means of fixing the elements 40 to the rigid sub-frame 34.

As mentioned before, instead of utilizing the small bars 45, small plates, such as 46, can be fastened to the fixing point 16, and each of these small plates can provide an anchor for a rod 40. In FIG. 8, the small bars are shown to extend transversely across the heating member 1 between the walls 5 and 6.

Figure 9:
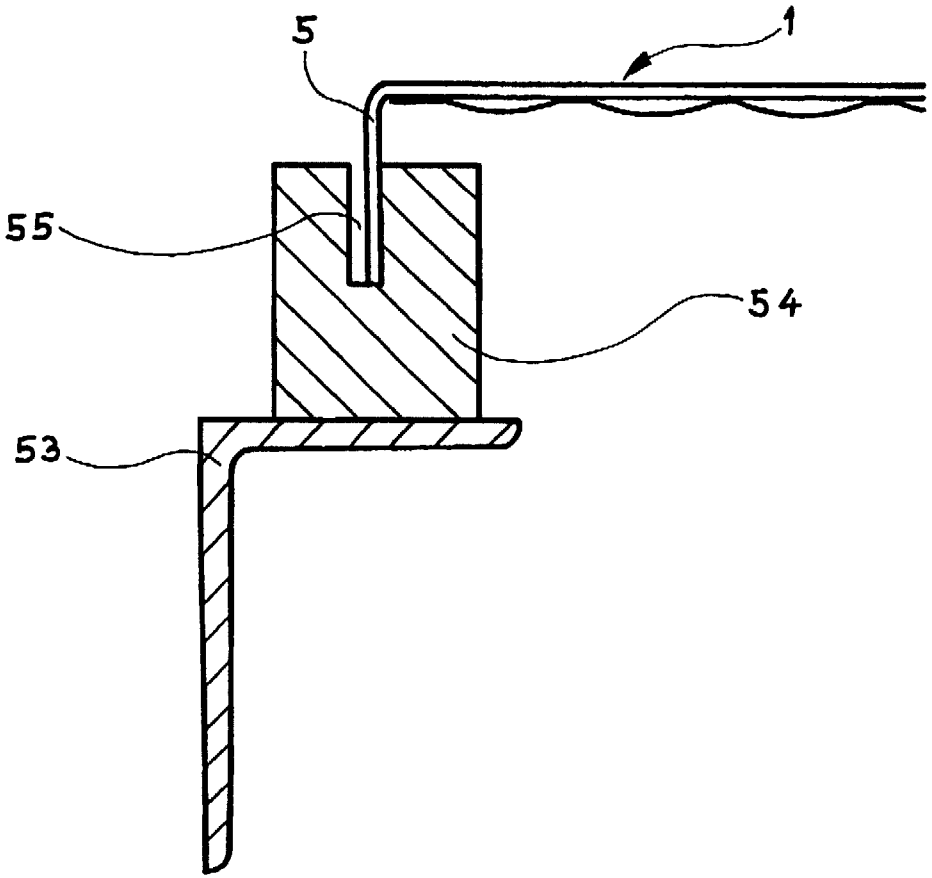
FIG. 9 is a cross sectional view taken along the lines IX—IX of FIG. 8.

Also shown in FIG. 8 is a modification for mounting the heating member on a frame member 53, which is connected to the side frames of the machine producing the corrugated board. In this arrangement, an edge or front wall 5 and an opposite or back wall 6 of the heating member 1 are used in order to connect the member to the frames of the machine producing the corrugated board. For this purpose, several blocks 54 are fastened on a frame member 53, as illustrated in FIGS. 8 and 9. These blocks are each provided with slots, such as 55, which will receive in a free manner a wall, such as 5, while the opposite wall 6 rests on a smooth block so that the wall 6 can be moved relative to the smooth block or member 53 in response to thermal expansion.

The choice of this kind of connection between the heating member 1 and the rigid frame 34 by means of elements, such as the rods, presents, among others, the advantage of avoiding a heat transmission from the member to the frame owing to a low connection cross section. If required, the structure of the connection allows the utilization of insulating connecting elements so as to reduce the heat transmission and, still further, to cancel any deformation of the rigid frame 34, which outwardly serves entirely as a rigid base for adjusting the inherent flatness of the transfer surface for the heating member 1.

Another advantage achieved by the device according to the present invention consists essentially in the fact that the heating member forms a very flexible membrane allowing the mechanical adjustment of the transfer surface through a rigid frame being independent of thermal conditions of the frame. In the establishment of a better heat transmission to the plane of the transfer surface, an improvement of the adjustment of the temperature owing to the low thermal inertia of the device and in the utilization of a low volume of the flow of the saturated steam allows a removal of a pressure accumulator or tank and, therefore, the reduction of the manufacturing costs owing to the possibility to realize a light construction for the device.

Although various minor modifications may be suggested by those versed in the art, it should be understood that we wish to embody within the scope of the patent granted hereon all such modifications as reasonably and properly come within the scope of our contribution to the art.

We claim:

1. A heating device for a machine producing corrugated cardboard and utilizing convection from a heating fluid circulating in a plate-shaped heat exchanger, comprises a heating member in which saturated steam is circulated, said heating member having a rectangular plate member with side walls, a front wall and a back wall integral with the plate member, a bottom surface of said plate member being connected to a deformed sheet of steel having a small thickness to form passages between the plate member and sheet, said sheet of steel having opposite edges folded at 45° to a plane of the sheet so as to form an inlet chamber and an outlet chamber for a heating fluid, said heating member being associated with a rigid sub-frame, connecting means for connecting the sub-frame to the heating member including adjustment elements fitted so as to avoid heat transmission between the heating member and the sub-frame, the heating member and sub-frame being fashioned in a floating manner within the machine for manufacturing corrugated cardboard in a way to take into consideration thermal expansion resulting from the heating of the heating member.

2. A heating device according to claim 1, wherein the sheet of thin steel has a thickness in a range of 0.5 mm and 1.5 mm and is welded on its peripheral edges to the side walls of the plate member, the sheet of steel having weld points to the bottom surface to form a staggered relationship to form the fluid passages therebetween.

3. A heating device according to claim 2, wherein the plate member with the downwardly extending side walls is formed by folding and welding a sheet of steel having a thickness of about 4 mm.

4. A heating device according to claim 2, wherein the welding points are spaced diagonally at a distance in a range of 28 mm to 30 mm.

5. A heating device according to claim 1, wherein the heating member is provided with a plurality of fixing points formed by threaded rods welded at places of certain welding points connected to the deformed sheet of steel having a small thickness to the plate member and the fixing points are designed to serve as anchor points in order to ensure a perfect connection with a sub-frame.

6. A heating device according to claim 5, wherein the fixing points serve as anchor points for small bars extending the whole width of the bottom surface of the plate member.

7. A heating device according to claim 5, wherein the fixing points serve as anchor points for small plates arranged in space manner on the width of the bottom surface of the plate member.

8. A heating device according to claim 1, wherein connecting elements between the heating member and the sub-frame are formed by rods fastened in an adjustable manner in the rigid sub-frame and in a floating manner to the heating member.

9. A heating device according to claim 1, wherein the connection between the heating member and the sub-frame has a side wall of the plate member freely received in a slot formed in a block attached to the frame member.

* * * * *